United States Patent [19]

Bedford

[11] Patent Number: 5,070,714

[45] Date of Patent: Dec. 10, 1991

[54] TAMPER RESISTANT LOCKING DEVICE

[76] Inventor: Steven G. Bedford, 224 Nagogami Ter., Rolla, Mo. 65401

[21] Appl. No.: 472,266

[22] Filed: Jan. 30, 1990

[51] Int. Cl.[5] ..... E05B 37/20

[52] U.S. Cl. ..... 70/289; 292/DIG. 63; 292/DIG. 65

[58] Field of Search ..... 70/289, 290, DIG. 81, 70/160; 292/DIG. 13, DIG. 63, 227, DIG. 37, DIG. 65

[56] References Cited

U.S. PATENT DOCUMENTS

| | | | |
|---|---|---|---|
| 840,054 | 1/1907 | Farrand | 70/289 |
| 1,567,135 | 12/1925 | Gregory . | |
| 2,484,597 | 10/1949 | Wegele | 70/88 |
| 2,936,189 | 5/1960 | Pearson | 292/DIG. 65 X |
| 2,972,879 | 2/1961 | Fry | 70/289 X |
| 3,109,900 | 11/1963 | Van Hook | 292/DIG. 13 X |
| 3,160,431 | 12/1964 | Anderson et al. | 292/DIG. 65 X |
| 3,631,444 | 7/1968 | Daniel | 340/274 |
| 3,772,574 | 11/1973 | Hughes | 70/DIG. 81 X |
| 3,893,721 | 7/1975 | Upton | 70/289 X |
| 3,999,792 | 12/1976 | Smith | 292/DIG. 63 X |
| 4,198,084 | 4/1980 | Trotta | 292/DIG. 63 X |
| 4,660,394 | 4/1987 | Wu | 70/25 |
| 4,714,030 | 12/1987 | Cole | 109/61 |

*Primary Examiner*—Gary L. Smith
*Assistant Examiner*—Suzanne L. Dino
*Attorney, Agent, or Firm*—Powers, Leavitt & Roedel Senniger

[57] ABSTRACT

A tamper resistant lock construction for a door, drawer, or similar closure is disclosed. A lock bolt releasably locks the closure. A plurality of finger openings are provided, each finger opening adapted to receive a finger. At least one actuator in each finger opening is positioned to be selectively operated by a finger inserted into the finger opening. The lock bolt is released only in response to the actuation of a preselected combination of the actuators.

19 Claims, 8 Drawing Sheets

TAMPER RESISTANT LOCKING DEVICE

BACKGROUND OF THE INVENTION

This invention relates to locking devices, and in particular to a locking device in which the actuators for releasing the lock are in protected openings to prevent their operation by children and to mask their operation from others.

There are a number of doors and drawers in a typical household that are frequently used by adults, but should not be accessible to children, for example on medicine cabinets and on storage cabinets for household cleaners and chemicals. It is inconvenient to secure these doors and drawers with conventional locks because each person having access to the door or drawer must have a key or combination for each lock. This is particularly inconvenient for doors and drawers that are frequently used.

SUMMARY OF THE INVENTION

What has been needed is a locking device with a release that can be easily operated by an adult, but which is inaccessible to children and preferably is not visible. Generally, the locking device of the present invention meets this need by providing a release including a plurality of finger holes or finger stalls, and at least one actuator in each finger opening, positioned to be operated by a finger inserted into the opening, and means for releasing the lock only in response to the actuation of a preselected combination of actuators.

The finger openings or finger stalls are preferably sufficiently long, and the actuators are positioned in the openings so that a child cannot operate the actuators. The finger openings also preferably have a bend in them to make the actuators more inaccessible to a child.

In a typical household application, there only needs to be one or two finger openings in order to prevent a child from releasing the locking device. However, by providing more finger openings, and or more actuators in the finger openings, the release of the lock can be made sufficiently secure that the locking device can be used to prevent other adults from releasing the locking device. Such a locking device has distinct advantages over conventional key-type locks because no key is required, and over conventional combination locks because the operation of the release is hidden from others, and is therefore more secure, and the actuators can be actuated simultaneously, so that the release is faster.

DETAILED DESCRIPTION OF THE PREFERRED EMBODIMENTS

Figure 1:
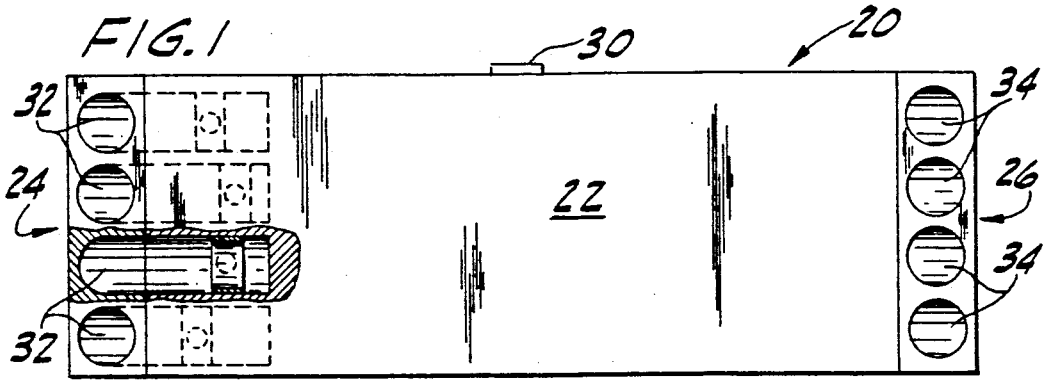
FIG. 1 is a front elevation view of a first embodiment of a locking device constructed according to the principles of this invention incorporated into a drawer front, with portions broken away to reveal details of construction.
Figure 2:
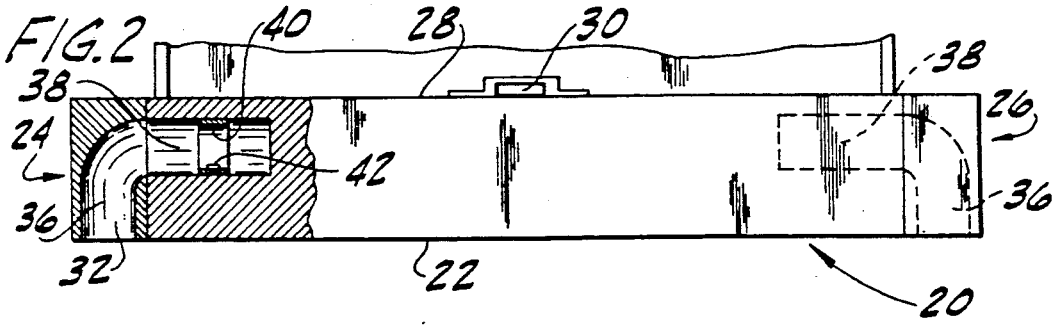
FIG. 2 is a top plan view of the first embodiment with portions broken away to reveal details of construction.

FIGS. 1 and 2 show a first embodiment of a locking device constructed according to the principles of this invention, incorporated into a drawer front 20. The drawer front 20 is adapted to be used on a conventional drawer of the type that is slidably mounted in a frame (not shown). The drawer front 20 has a front face 22, left and right sides 24 and 26, and a rear face 28. A locking tang 30 is mounted on the rear face 28 of the drawer front 20 for reciprocal movement between extended and retracted positions. In the extended position the tang 30 extends sufficiently from the drawer front 20 to engage the frame and secure the drawer against movement; in the retracted position the tang does not engage the frame and the drawer can be moved.

In the front face 22 of the drawer front 20 there is a set of four finger openings 32 adjacent the left side 24, and a set of four finger openings 34 adjacent the right side 26. Each of the finger openings 32 and 34 has a generally L-shaped configuration with an outer portion 36 extending rearwardly from the mount of the opening in the front face 22, and an inner portion 38 at a right angle to the outer portion, extending generally in the plane of the drawer front toward the center of the drawer. The openings 32 and 34 are mirror images of each other, and are otherwise of identical construction. The finger openings 32 and 34 of each set are sized, shaped, and spaced so that the fingers of one hand can be comfortably inserted into them.

A ring 40 is friction fit in the inner portion 38 of each of the finger openings Each of the rings 40 can slide within its respective inner portion 38 so that the position of the ring relative to the mouth of the finger opening can be adjusted. At least one actuator, for example a push-button 42, is positioned on each ring. The rings can be positioned so that the push buttons are out of the reach of children with short fingers, yet still within the reach of adults. Of course, the push-buttons 42 could be permanently mounted in the finger openings, if desired.

Figure 3:
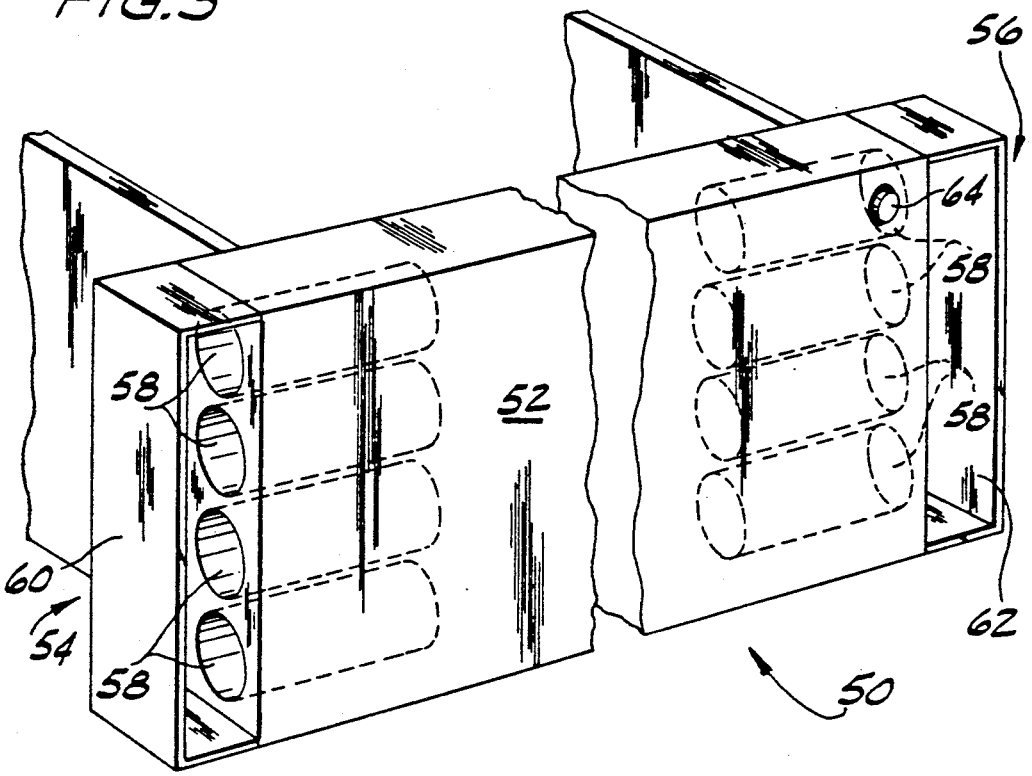
FIG. 3 is a partial perspective view of a second embodiment of a locking device constructed according to principles of this invention incorporated into a drawer front.

A second embodiment of a locking device constructed according to the principles of this invention, incorporated into a drawer front 50, is shown in FIG. 3. The drawer front 50 is adapted to be used on a conventional drawer of the type that is slidably mounted in a frame (not shown). The drawer front 50 has a front face 52, left and right sides 54 and 56. A locking tang (not shown) is mounted on the rear face of the drawer front 50 for reciprocal movement between extended and retracted positions. In the extended position the tang extends sufficiently from the drawer front 50 to engage the frame and secure the drawer against movement; in the retracted position the tang does not engage the frame and the drawer can be moved.

In each side of the drawer front 50 there is a set of four finger openings 58. Each of the finger openings 58 extends generally inwardly from its respective side toward the center of the drawer front. The finger openings 58 of each set are sized, shaped, and spaced so that the fingers of one hand can be comfortably inserted into them. Left and right shields 60 and 62 are secured over the left and right sides 54 and 56 of the drawer front 50. The shields block access to the finger openings except from the front.

At least one actuator, for example a push-button 64, is positioned in each of the finger openings 58. The push-buttons 64 are preferably positioned in the openings 58 so that they are out of the reach of children with short fingers, yet still within the reach of adults. Of course, the push-buttons 64 could be adjustably mounted in the openings 58, if desired.

Figure 4:
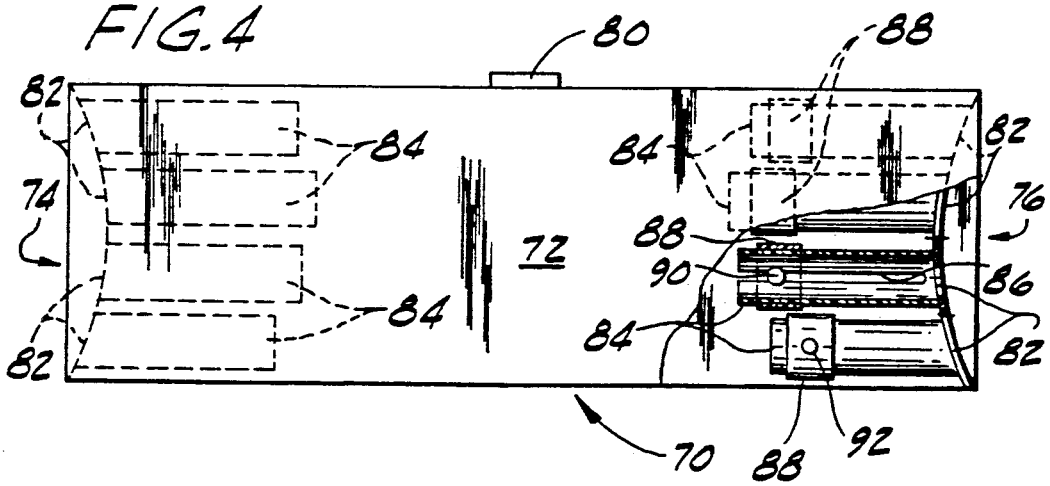
FIG. 4 is a front elevation view of a third embodiment of a locking device constructed according to the principles of this invention incorporated into drawer front, with portions broken away to reveal details of construction.
Figure 5:
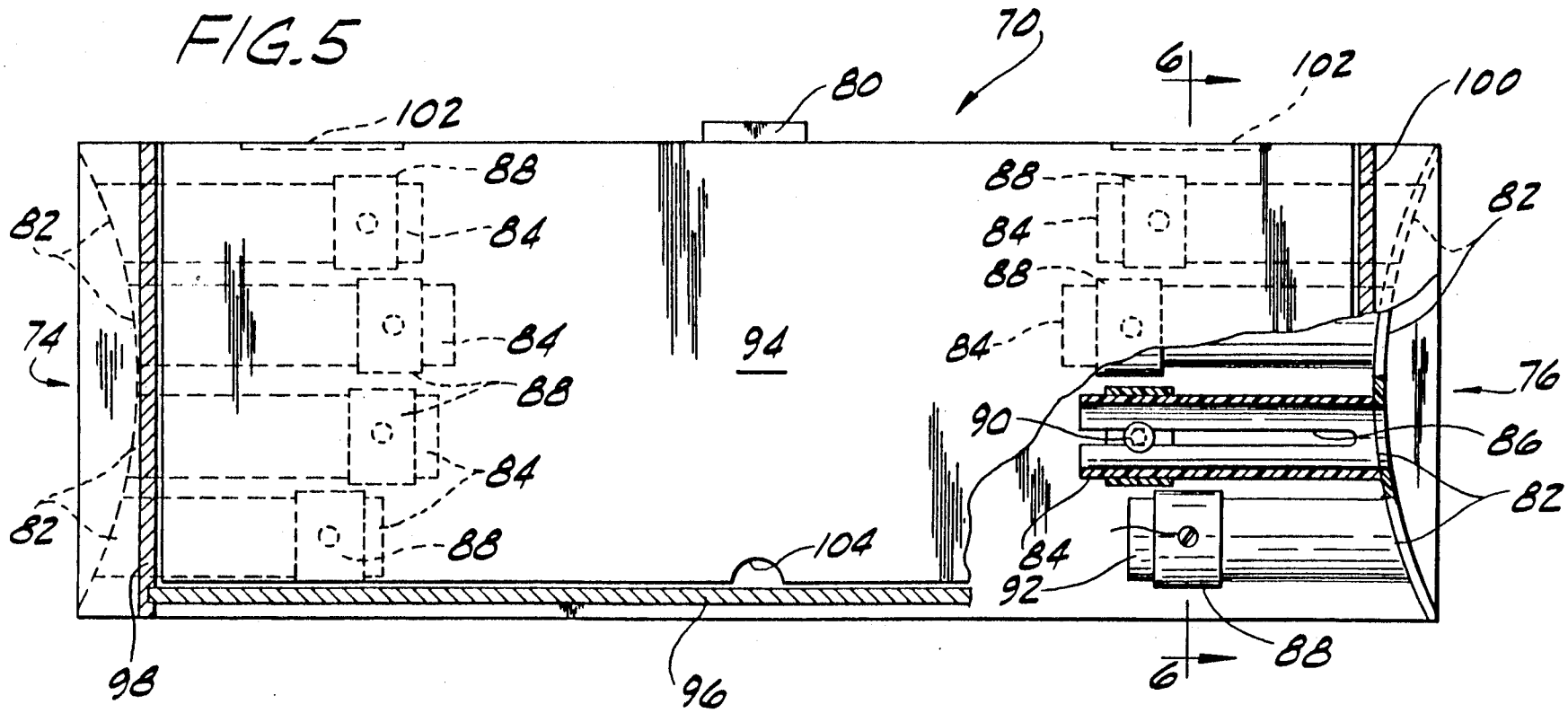
FIG. 5 is an enlarged rear elevation view of the third embodiment, with portions broken away to reveal details of construction.
Figure 6:
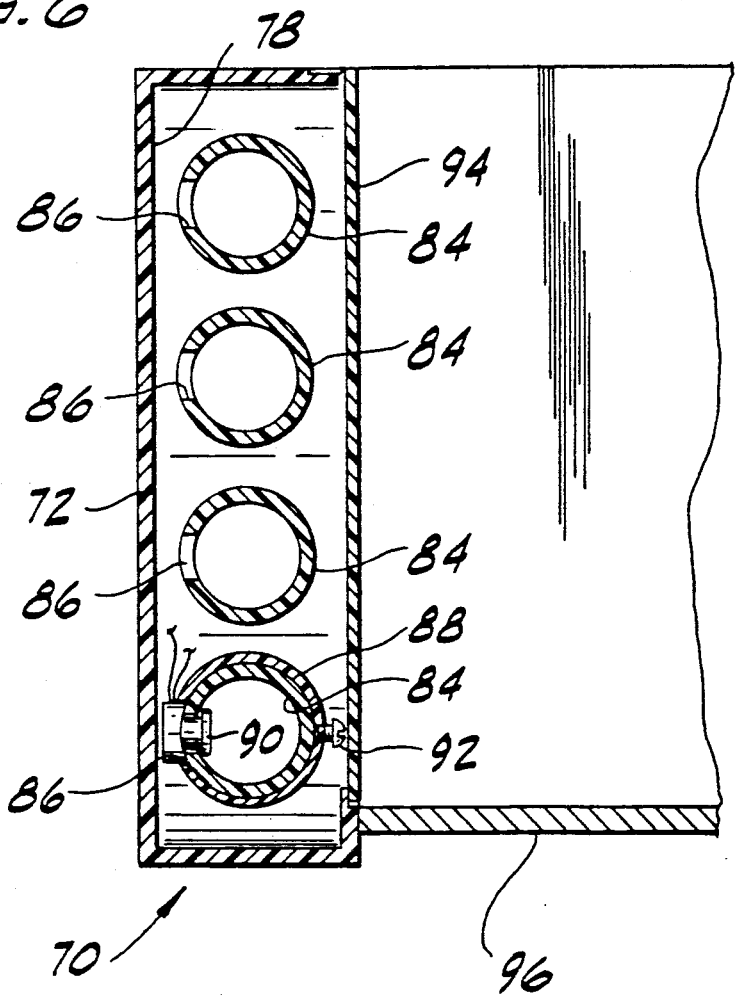
FIG. 6 is a cross-sectional view of the third embodiment, taken along the plane of line 6—6 in FIG. 5.

A third embodiment of a locking device constructed according to the principles of this invention, incorporated into a drawer front 70, is shown in FIGS. 4–6. The drawer front 70 is adapted to be used on a conventional drawer of the type that is slidably mounted in a frame (not shown). The drawer front 70 has a front face 72, left and right sides 74 and 76, and a rear face 78. A locking tang 80 is mounted in the drawer front 70 for reciprocal movement between extended and retracted positions. In the extended position the tang 80 extends sufficiently from the drawer front 70 to engage the frame and secure the drawer against movement; in the retracted position the tang 80 does not engage the frame and the drawer can be moved.

In each side of the drawer front 70 there is a set of four finger openings 82. Each of the finger openings 82 extends generally inwardly from its respective side toward the center of the drawer front. The finger openings 82 of each set are sized, shaped, and spaced so that the fingers of one hand can be comfortably inserted into them. As is apparent from FIG. 4, the mouths of the openings are positioned along a concave curve to accommodate the shape of the hand.

Each of the finger openings comprises a tube 84 extending inwardly from the mouth of the opening. Each tube has at least one slot 86 extending longitudinally along substantially the entire length of the tube 84. A ring 88 is slidably mounted over each of the tubes 84. At least one actuator, such as a push-button 90, is mounted on the inside of each ring. The push-button 90 on each ring extends through the slot 86 so that it is accessible inside the tube 84. The rings, and thus the push-buttons can slide along the tube, and thus the position of the push-buttons relative to the mouths of the openings can be adjusted. The push-buttons 90 are preferably positioned so that they are out of the reach of children with short fingers, yet still within the reach of adults. Once properly positioned on the tubes 84, the rings can be secured with set screws 92.

As best shown in FIG. 5, a panel 94 is mounted on the rear face of the drawer front, above the bottom 96 and between the sides 98 and 100 of the drawer. The panel is mounted with hinges 102 and has a finger grip 104 so that the panel 94 can be lifted to expose the tubes and rings to permit the positions of the rings to be adjusted.

Figure 7:
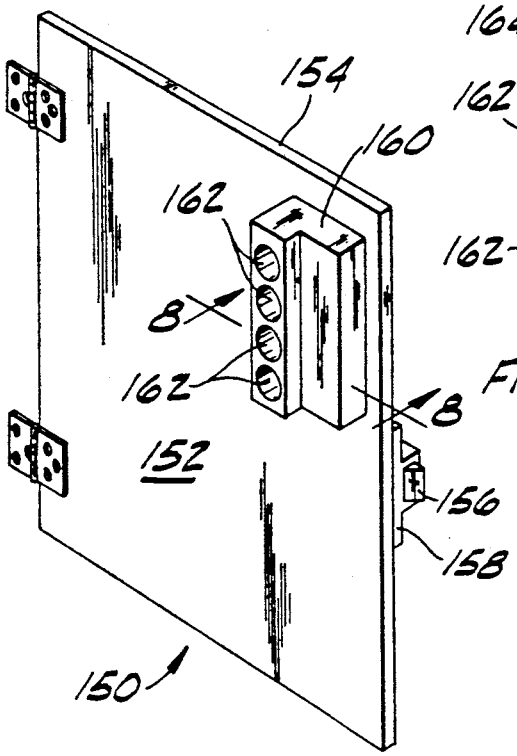
FIG. 7 is a perspective view of a fourth embodiment of a locking device constructed according to the principles of this invention incorporated into a door.
Figure 8:
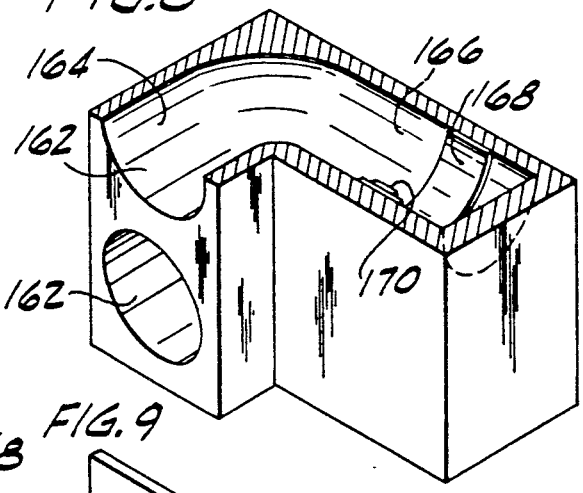
FIG. 8 is a partial cross-sectional view in perspective of the fourth embodiment, taken along the plane of line 8—8 in FIG. 7.

A fourth embodiment of a locking device constructed according to the principles of this invention, incorporated into a door 150 for a cabinet or locker, is shown in FIGS. 7 and 8. The door 150 is adapted for hinged mounting on a door frame (not shown) on a cabinet, a locker, or the like. The door 150 has a front face 152 and a rear face 154. A locking tang 156 is mounted in a locking unit 158 on the rear face of the door, adjacent an edge. The tang 156 is mounted for reciprocal movement between extended and retracted positions. In the extended position the tang 156 extends sufficiently from the door 150 to engage the frame and secure the door 150 against movement; in the retracted position the tang 156 does not engage the door frame and the door can be moved.

An actuation unit 160 is mounted on the front face of the door 150. The actuation unit has a set of finger openings 162. Each of the finger openings has a generally L-shaped configuration with an outer portion 164 extending rearwardly from the mouth of the opening, and an inner portion 166 at a right angle to the outer portion. The finger openings 162 are sized, shaped, and spaced so that the fingers of one hand can be comfortably inserted into them.

A ring 168 is friction fit in the inner portion 166 of each of the finger openings. Each of the rings 168 can slide within its respective inner portion 166 so that the position of the ring relative to the mouth of the finger opening can be adjusted. At least one actuator, for example a push-button 170, is positioned on each ring. The rings can be positioned so that the push buttons are out of the reach of children with short fingers, yet still within the reach of adults. Of course, the push-buttons 170 could be permanently mounted in the finger openings, if desired.

Figure 9:
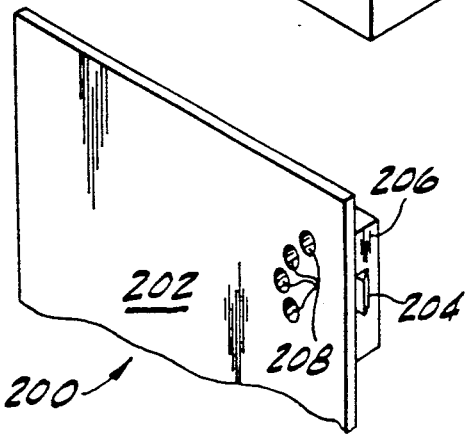
FIG. 9 is a perspective view of a fifth embodiment of a locking device constructed according to the principles of this invention incorporated into a door.

A fifth embodiment of a locking device constructed according to the principles of this invention, incorporated into a door 200 for a cabinet or locker, is shown in FIG. 9. The door 200 is adapted for hinged mounting on a door frame (not shown) on a cabinet, a locker, or the like. The door 200 has a front face 202 and a rear face. A locking tang 204 is mounted in a locking unit 206 on the rear face of the door, adjacent an edge. The tang 204 is mounted for reciprocal movement between extended and retracted positions. In the extended position the tang 204 extends sufficiently from the door 200 to engage the frame and secure the door 200 against movement; in the retracted position the tang 204 does not engage the door frame and the door can be moved.

There is a set of finger openings 208 in the front face 202 of the door 200. The finger openings 208 are sized, shaped, and spaced so that the fingers of one hand can be comfortably inserted into them. The openings are preferably arranged in a curved pattern. There is at least one actuator, such as a push button, in each of the openings. The push-button is preferably positioned so that they are out of the reach of children with short fingers, yet still within the reach of adults. Of course, the push-buttons could be adjustably mounted in the finger openings, if desired.

The push-buttons of the first, second, third, fourth, and fifth embodiments all are part of a similar electronic locking system 300. When the proper combination of the push-buttons in a particular embodiment is actuated, the electronic system 300 allows the tang to retract. This electronic system 300 is shown schematically in FIGS. 10 and 11. The system is descriped in relation to a drawer, although the description applies equally to a door or other closure.

Figure 10:
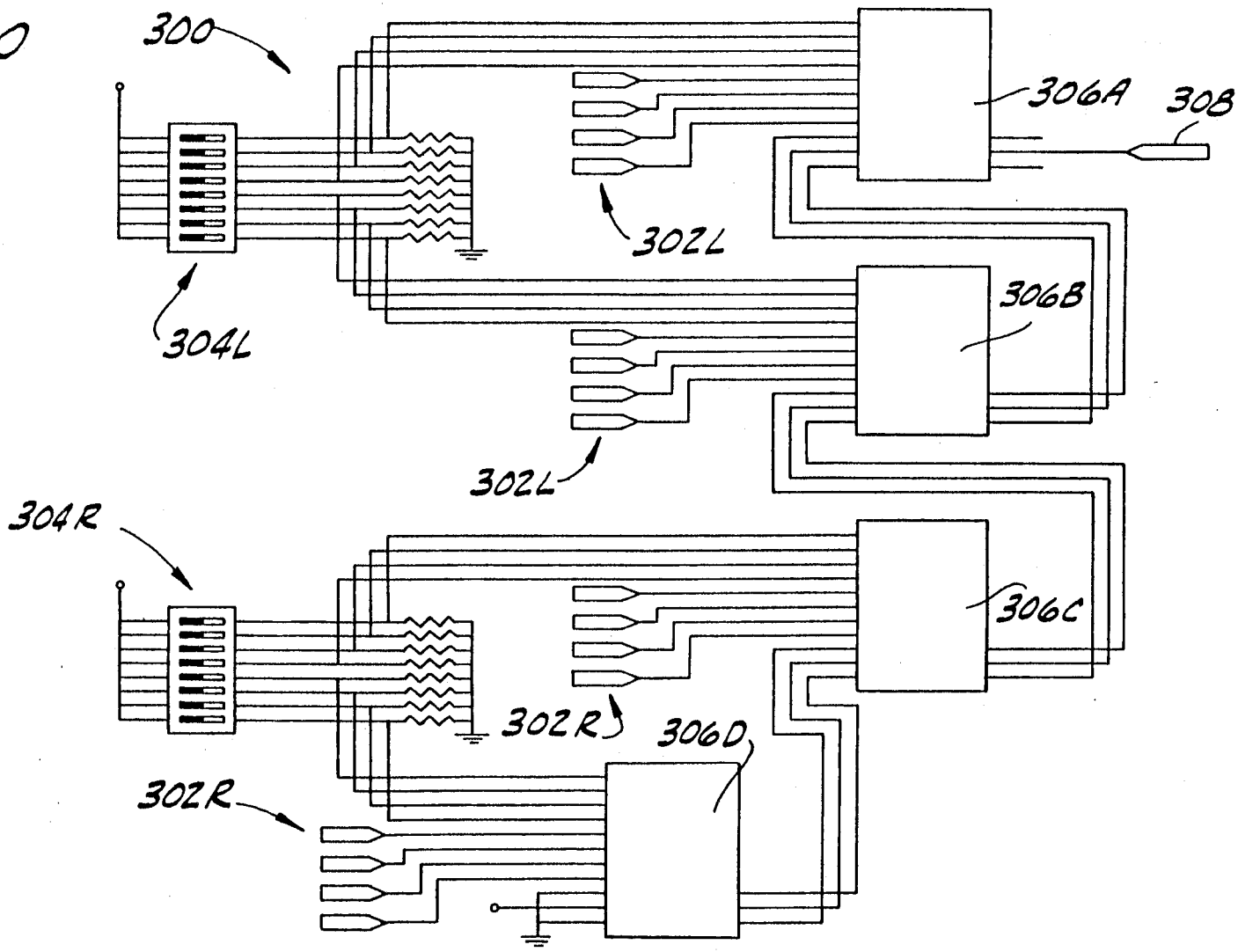
FIG. 10 is a block diagram of the electronics used in the electronic embodiments of this invention to compare the input patterns with the predetermined patterns.

As shown in FIG. 10, the system 300 comprises input means, 302L and 302R, for receiving the input for operating the electronic locking system from the left and right hands, respectively. The input means comprises the push-buttons of the particular embodiment. As shown in FIG. 10, there are eight individual push buttons for each input means 302L and 302R, so that there are two push buttons for each finger. Two push buttons per finger has been selected for illustration purposes, and there could be fewer or more push buttons if desired. The system 300 further comprises setting means, 304L and 304R, for setting a predetermined pattern of the input means for the left and right hands, respectively, which will cause the electronic locking system to unlock. The setting means 304L and 304R preferably comprise a set of DP switches, one switch for each push button. Comparators 306A, 306B, 306C, and 306D compare the patterns input via input means 302L and 302R with the patterns established by the setting means 304L and 304R. Each of these comparators may be a 14585 comparator chip. The comparators are interconnected so that if, and only if, the input pattern is identical to the predetermined pattern a match signal is generated at 308.

Figure 11:
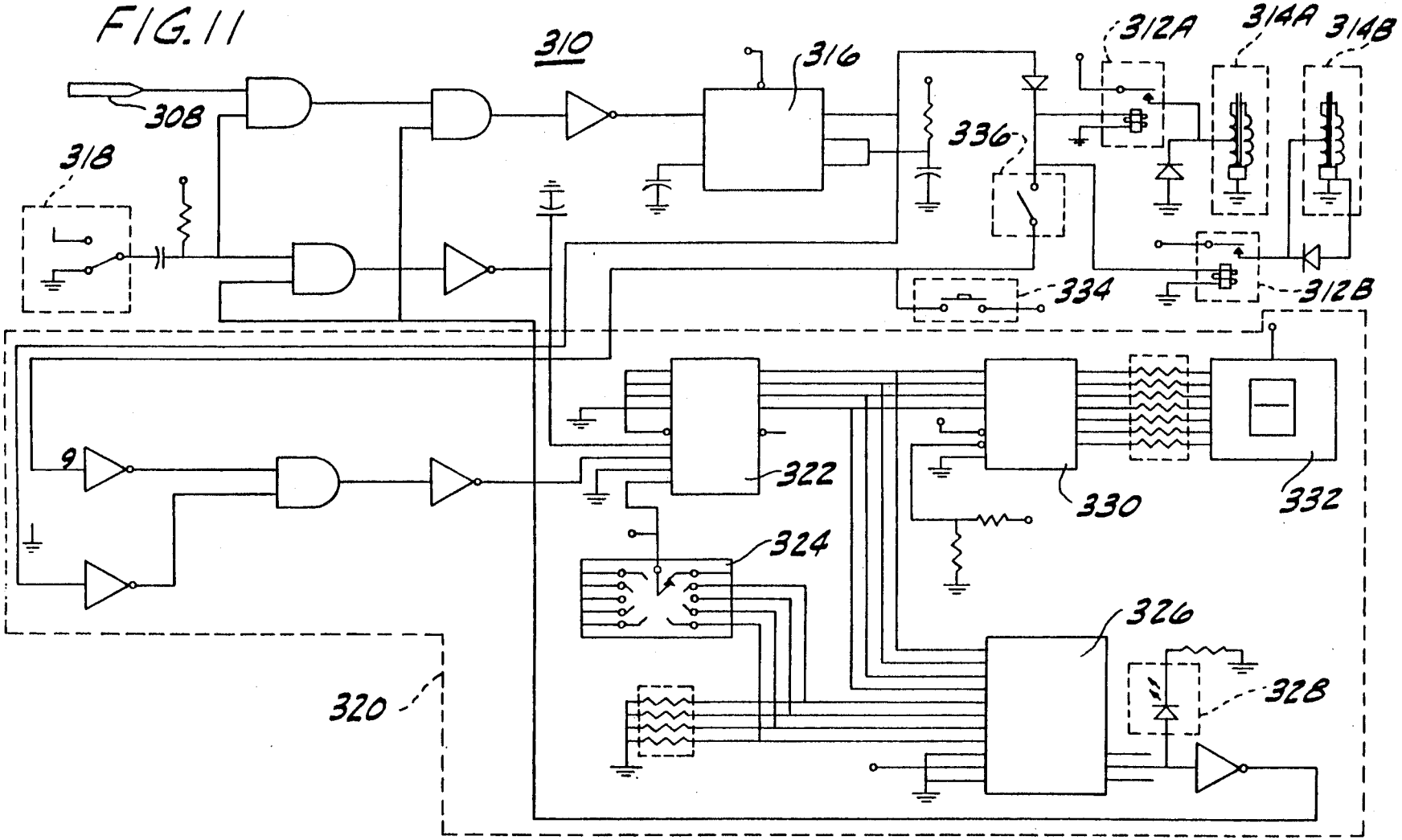
FIG. 11 is a block diagram of the electronic used to lock and unlock the device.

As shown in FIG. 11, the signal generated at 308 is provided to an unlock logic circuit 310 as shown in the Figure. When the proper signal is provided at 308, and other conditions are met, the circuit 310 actuated a timer 316 to temporarily energize relays 312A and 312B, which temporarily energize solenoids 314A and 314B, respectively. The solenoids 314A and 314B cooperate to move the tang. The timer 316 may be a LM555 timer chip, the period of which is set to unlock the tang for a relatively short period to permit the drawer to be opened.

The circuit 310 comprises a drawer position switch 318. As shown in FIG. 11, the switch is in the position indicating that the drawer is closed. If an attempt is made to open the drawer, or if the drawer is opened, the switch 318 moves to its other position.

The circuit 310 also includes a security circuit 320 for controlling the number of attempts (as indicated by switch 318) permitted to open the drawer. The circuit 320 is arranged so that circuit 310 will not operate the tang if a preselected maximum number of attempts to open the drawer has been exceeded. This feature is particularly useful where there are a small number of actuators and the number of possible combinations is small. The security circuit 320 comprises a counter 322 (which may be, for example a 14029 counter chip), and a multiple position switch 324 for setting the number of attempts permitted. A comparator 326 compares the number of attempts to open the drawer as detected by the counter 322 with the number of permitted attempts allowed as set by the switch 324. The comparator may be a 14585 comparator chip. When the number of attempts equals the number of permitted attempts an LED 328 is energized to indicate that the maximum number of attempts has been exceeded. The security circuit 320 may also include a display driver 330 (which may be a 14511 display driver chip) and an LED display 332 (which may be a 7-segment display device for displaying single digit numerals) for displaying the number of attempts.

The circuit 310 also includes a key-operated reset switch 334. Depending upon the position of a reset control switch 336, operation of the key-operated reset switch 334 will either (1) reset the number of attempts counter, to allow further attempts to open the drawer, or (2) open the drawer and reset the number of attempts counter. As shown in FIG. 11, the reset control switch 336 is in its open position so that actuation of the reset switch 334 will merely reset the number of attempts counter.

Figure 14:
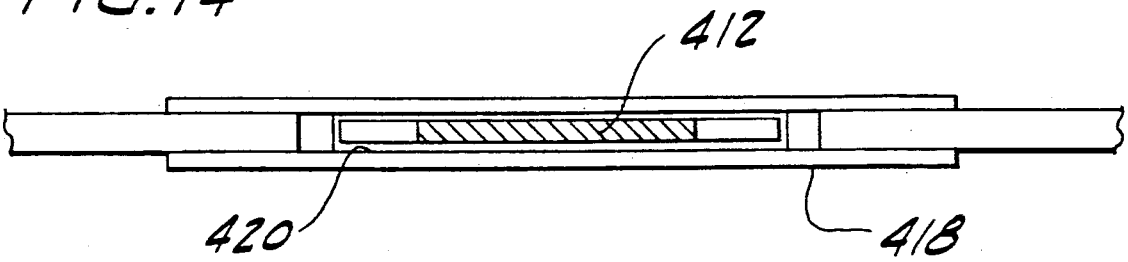
FIG. 14 is a partial cross-sectional view of the sixth embodiment, taken along the plane of line 14-14 in FIG. 12.
Figure 12:
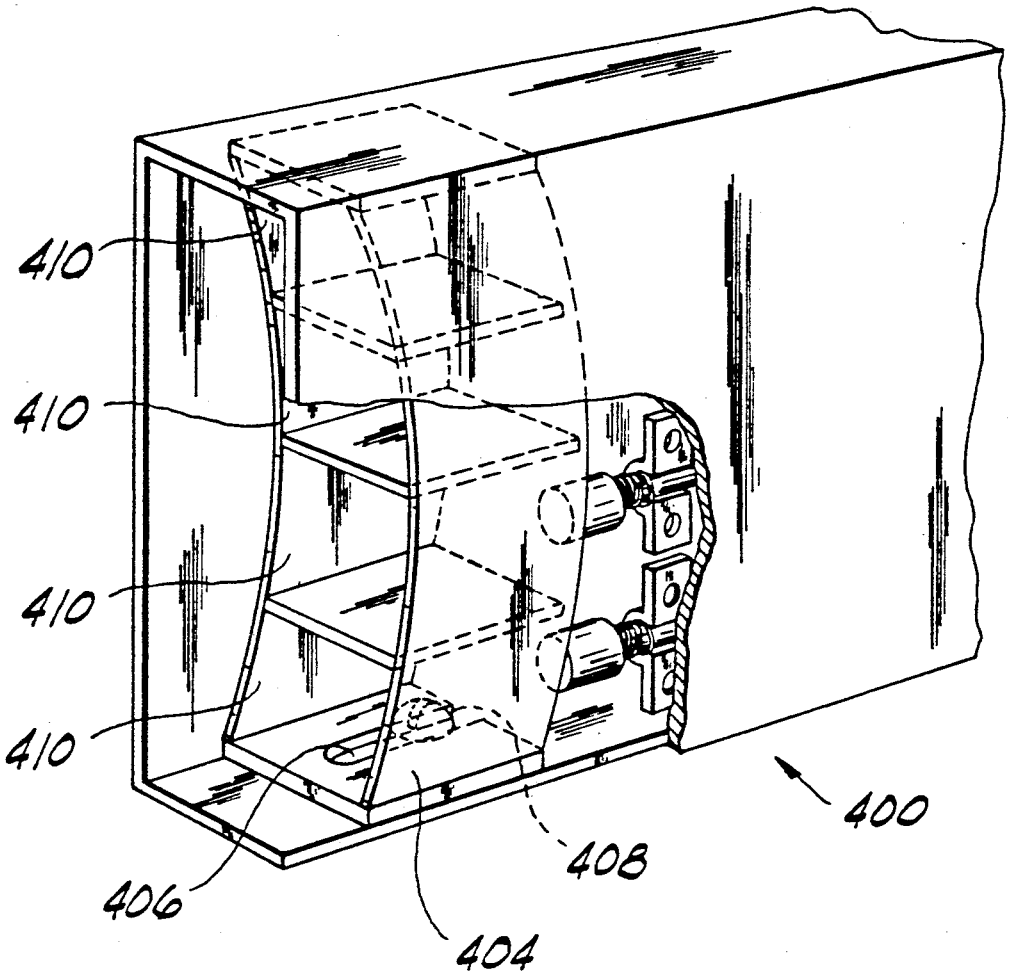
FIG. 12 is a partial perspective view of a sixth embodiment of a locking device constructed according to the principles of this invention, incorporated into a drawer front, with portions broken away to reveal details of construction.
Figure 13:
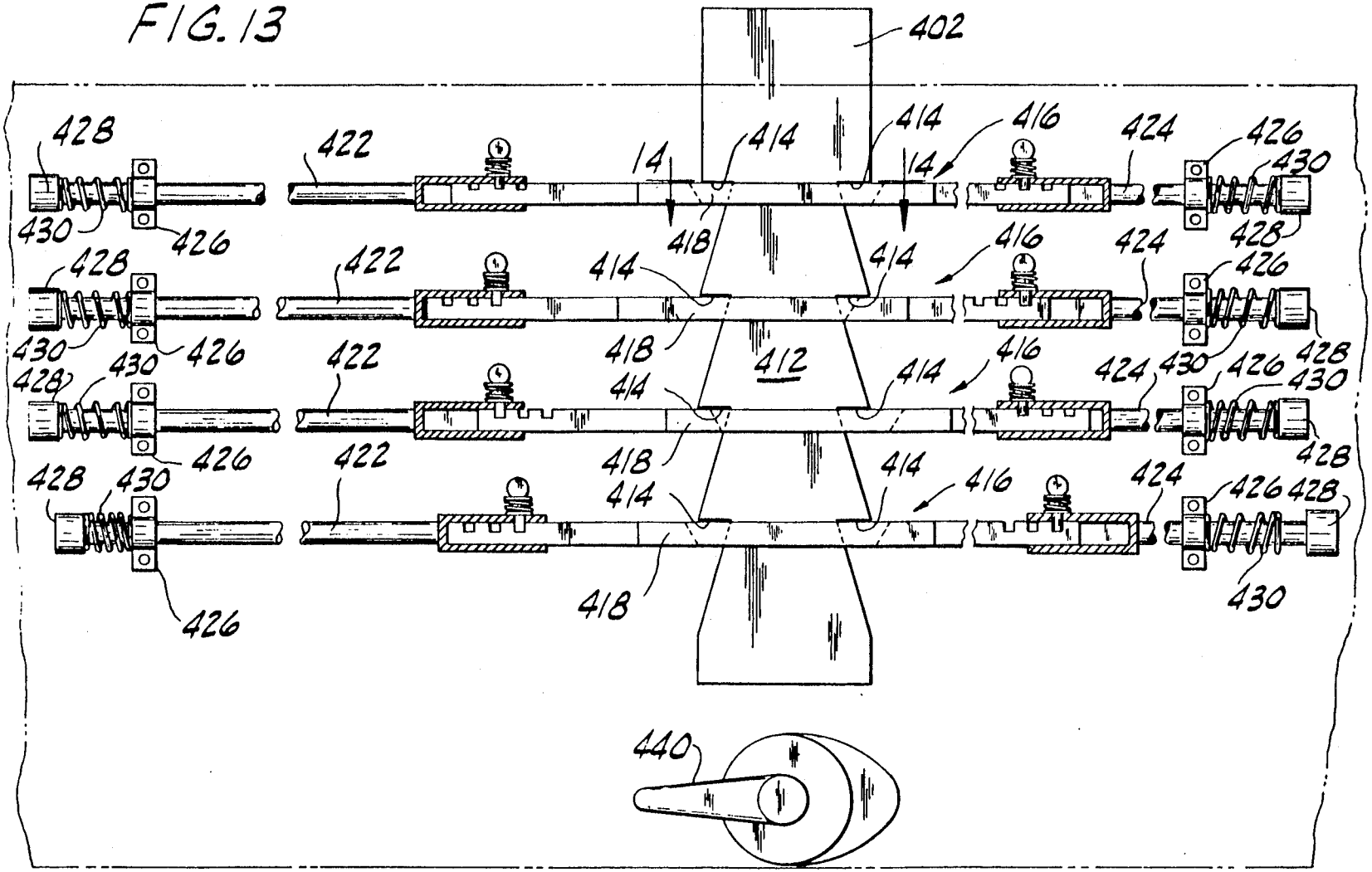
FIG. 13 is an enlarged rear elevation view of the sixth embodiment, showing the details of the locking device.

A sixth embodiment of a locking device constructed according to the principles of this invention, incorporated into a drawer front 400 is shown in FIGS. 12–14. The drawer front 400 is adapted to be used on a conventional drawer of the type that is slidably mounted in a frame (not shown). The drawer front 400 has a front face, left and right sides, and a rear fact. A locking tang 402 is mounted on the drawer front 400 for reciprocal movement between extended and retracted positions. In the extended position (FIG. 13) the tang 402 extends sufficiently from the drawer front 400 to engage the frame and secure the drawer against movement; in the retracted position the tang does not engage the frame and the drawer can be moved.

As shown in FIG. 12, the left and right sides of the drawer are open. A hand gate 404 is adjustably mounted in each open side. The hand gate has a track 406 therein for receiving a screw 408 for adjustably mounting the hand gate in the opening. Each hand gate has a generally concave curved configuration to accommodate a hand. Moreover each hand gate is divided into a plurality of individual finger stalls 410, each stall adapted to receive a finger. The finger stalls 410 of each hand gate are sized, shaped, and spaced so that the fingers of one hand can be comfortably inserted into them.

The tang 402 has a depending portion 412, the sides of which have a plurality of pairs of downwardly facing shoulders 414 on opposite sides of the tang 402, which give the depending portion a generally toothed configuration. In this preferred embodiment there are preferably four pairs of shoulders 414. There is a locking mechanism 416 for each of the pairs of shoulders. Each locking mechanism comprises a collar 418 having an opening 420 for receiving the depending portion 412 of the tang. Each collar 418 thus surrounds the depending portion of the tang, and is generally aligned with one of the pairs of shoulders. The opening 420 is sized so that the depending portion of the tang 412 can slide freely therein.

Two rods, 422 and 424, are adjustably attached to the left and right sides of each collar. Each of the rods 422 and 424 is slidably mounted on the back of the drawer front 400 with a U-shaped bracket 426. The free end of each of the rods, 422 and 424, has an enlarged end cap 428. A coil spring 430 is disposed on the end of each rod between the U-shaped mounting bracket 426 and the cap 428. The springs allow each locking mechanism 416 to be displaced to the left or to the right by pushing on the end cap 428 on the right or left side of the locking mechanism.

As noted above the position of each of the rods 422 and 424 with respect to the collar 418 is adjustable. Specifically, rod 422 can be mounted in an outer position, and middle position, or an inner position with respect to the collar 418. Likewise, the rod 424 can be mounted in an outer position, a middle position, and an inner position with respect to the collar 418. Both the rods must be in the middle positions, or one of the rods must be in its inner position and the other rod must be in its outer position. When both the rods 422 and 424 are in their center positions, the collar 418 is centered around the tang 402, and the tang can freely slide relative to the collar. When one of the rods is in its outer position and the other rod is in its inner position, then collar 418 is skewed one way and can engage one of the shoulders on the tang, and can only be released if the locking mechanism is displaced.

Some of the locking mechanisms can be set up so that the rods are in their middle positions, like the top-most locking mechanism in FIG. 13. If either of the end caps is pressed on a locking mechanism configured this way, it will bring the collar into locking engagement with the tang. Some of the locking mechanisms can be set up so that the left rod is in its inner position and the right rod is in its outer position. The collar will be in locking engagement with the shoulder on the right side of the tang, unless the mechanism is displaced to the right by pressing the end cap on the left, as is shown with respect to the bottom locking mechanism in FIG. 13. Some of the locking mechanisms can be set up so that the left rod is in its outer position and the right rod is in its inner position. The collar will be in locking engagement with the shoulder on the left side of the tang, unless the mechanism is displaced to the left by pressing the end cap on the right.

Thus the tang is only released if the locking mechanisms are operated correctly. For example in FIG. 13, the tang is only released if neither side of the top mechanism is pressed, if the left side of the second mechanism is pressed, if the right side of the third mechanism is pressed, and the left side of the fourth mechanism is pressed (as shown). When the proper combination is pressed the tang is released and can be retracted (or as shown in FIG. 13 can fall by gravity). A pivotally mounted cam member 440 (which is preferably controlled by a key lock) can be turned to cam the tang upwardly to restore it to its locked position.

The hand gate 404 is preferably positioned so that the end caps cannot be reached by a child with small fingers, but can be reached by an adult. Thus, only an adult can attempt to operate the device, and only an adult with the correct combination can actually operate the device.

OPERATION

The drawer front 20 of the first embodiment is opened by inserting one's fingers into the finger holes 32 and 34, and actuating the push buttons 42 according to the preselected pattern. The location of the push buttons is adjustable by moving the rings 40 in section 38. The drawer front 50 of the second embodiment is opened by inserting one's fingers into the finger openings 58, actuating the push buttons 64 according to the preselected pattern. The location of the pushbuttons may be made adjustable. The drawer front 70 of the third embodiment is opened by inserting one's fingers into the finger holes 82 and operating push buttons 90 according to the preselected pattern. The location of the push buttons is adjustable by sliding rings 88. The door 150 of the fourth embodiment is opened by inserting one's fingers into the finger holes 162, and actuating the pushbuttons 170 according to the preselected pattern. The location of the push buttons is adjustable by moving ring 168 is section 166. The door 200 of the fifth embodiment is opened by inserting one's fingers into the finger holes 208, and actuating the push buttons according to the preselected pattern. The location of the push buttons can be made adjustable.

The preselected pattern is established with circuit 300. The pattern is set with DP switches 304L and 304R. When the push buttons (represented as 302L and 302R in circuit 300) are actuated, the pattern is compared by comparators **306*a*, 306B, 306C, and 306D. If the patterns correspond a positive signal is generated at 308**.

The output at 308 is the input to the unlocking portion of the circuit 310. If pattern is correct, and the maximum number of attempts has not been exceeded, then timer 316 will momentarily actuate relays 312A and 312B which energize solenoids 314A and 314B to operate the lock tang.

The switch 318 detects when there is an attempt to open to lock, and circuit 320 controls the maximum number of attempts. The maximum number of attempts is set by switch 324, and the actual number of attempts is counted by counter 322. When the comparator 326 determines that the actual number of attempts exceeds the maximum number of attempts, the circuit 310 is disabled, and will not operate the tang without being reset by key operated switch 334. Also, when the maximum number of attempts has been exceeded, LED 328 is activated. Display 332 may also be provided to provide a display of the number of attempts.

The drawer 400 of the sixth embodiment is opened by inserting one's fingers into the finger stalls 410 of the hand guard 404 and pressing the end caps 428 to operate the locking mechanisms 416 in the preselected pattern to release the tang. The relative position of the end caps can be adjusted by moving the hand guard. The tang can be reset by operating camming member 440 to restore the tang to its extended position. The tang has sloped surfaces to cam the locking mechanisms 416 out of the way as the tang moves to its extended position.

What is claimed is:

1. An improved release for lock that makes something secure or inaccessible, the release comprising:

a plurality of finger openings located adjacent each other, each adapted to simultaneously receive a finger from a single hand;

at least one actuator in each finger opening, positioned in the opening to be actuated by a finger inserted into the opening; and means for releasing the lock only in response to the actuation of a preselected combination of the actuators.

2. The improved release according to claim 1 wherein the means for releasing the lock only releases the lock in response to the simultaneous actuation of the preselected combination of actuators.

3. The improved release according to claim 1 wherein the finger openings are sufficiently long and the actuators are positioned in the finger openings so that a child cannot actuate the actuators.

4. The improved release according to claim 1 wherein the depths of the finger openings are adjustable.

5. The improved release according to claim 1 further comprising means for storing the preselected combination, wherein the actuators comprise finger actuable switches, and wherein the releasing means comprises means for comparing the actuated switches to the preselected combination stored in the storing means and for providing an output signal in the event that the actuated switches correspond to the preselected combination, and a circuit, responsive to the output signal, for releasing the lock.

6. The improved release according to claim 5 wherein the circuit comprises a solenoid activated in response to the output signal to release the lock.

7. The improved release according to claim 1 further comprising means for counting the consecutive number of attempts that are made to release the lock, and for temporarily preventing release of the lock means if the number of attempts exceeds a preselected number.

8. A tamper resistant lock construction for a door, drawer, or similar closure, the lock construction comprising:

means for releasably locking the closure;

a plurality of finger openings located adjacent each other, each adapted to simultaneously receive a finger from a single hand;

at least one actuator in each finger opening positioned to be selectively operated by a finger inserted into the finger opening;

means for releasing the lock means only in response to the actuation of a preselected combination of the actuators.

9. The tamper resistant lock construction according to claim 8 wherein the means for releasing the lock only releases the lock in response to the simultaneous actuation of the preselected combination of actuators.

10. The tamper resistant lock construction according to claim 8 wherein the finger openings are sufficiently long, and the actuators are positioned in the finger openings so that a child cannot actuate the actuators 11. The tamper resistant lock construction according to claim 10 wherein the finger openings are curved.

12. The tamper resistant lock construction according to claim 8 wherein the depths of the finger openings are adjustable.

13. The tamper resistant lock construction according to claim 8 wherein the lock means comprises a lock bolt that moves between a locked position in which the closure is locked and an unlocked position in which the closure is unlocked, and wherein the means for releasing the lock means comprises at least one means for engaging the lock bolt and retaining the lock bolt in its locked position and disengaging the lock bolt upon the actuation of a preselected actuator, and at least one means for engaging the lock bolt and retaining the lock bolt in its locked position upon the actuation of a preselected actuator.

14. The tamper resistant lock construction according to claim 8 wherein the lock means comprises a lock bolt that moves between a locked position in which the closure is locked and an unlocked position in which the closure is unlocked, and wherein the means for releasing the lock means comprises means for engaging and retaining the lock bolt in its locked position and means for comparing the combination of actuators actuated with a preselected combination and releasing the lock bolt when the combination corresponds to the preselected combination.

15. The tamper resistant lock construction according to claim 12 wherein the means for comparing and releasing includes a solenoid activated to move the lock bolt to its unlocked position when the combination corresponds to the preselected combination.

16. The tamper resistant lock construction according to claim 8 further comprising means for counting the consecutive number of attempts that are made to open the lock means, and for temporarily preventing release of the lock means if the number of attempts exceeds a preselected number.

17. The tamper resistant lock construction according to claim 8 further comprising means for counting the number of attempts that are made to open the door, drawer, or closure, and for temporarily preventing release of the lock means if the number of attempts exceeds a preselected number.

18. The tamper resistant lock construction according to claim 17 further comprises means for selecting and storing the preselected number of attempts, and means for comparing the number of attempts with the preselected number of attempts.

19. The tamper resistant lock construction according to claim 17 further comprising means for detecting attempts to open the door, drawer, or closure.

* * * * *